United States Patent [19]

Halpern

[11] Patent Number: 5,035,840

[45] Date of Patent: Jul. 30, 1991

[54] PROCESS FOR CLEANING TRACE METALS FROM EDTA

[75] Inventor: Yuval Halpern, Skokie, Ill.

[73] Assignee: Chemical Waste Management, Inc., Oak Brook, Ill.

[21] Appl. No.: 591,548

[22] Filed: Oct. 1, 1990

[51] Int. Cl.[5] ..... G21F 9/08; G21F 9/14

[52] U.S. Cl. ..... 252/632; 252/631; 423/8; 423/9; 423/11; 423/15; 203/38; 210/682; 210/729; 556/148; 556/137; 560/169; 562/554; 562/566

[58] Field of Search ..... 423/8, 11, 15, 9; 252/626, 632, 631; 210/682, 729; 203/38; 560/169; 556/148, 137; 562/554, 566

[56] References Cited

U.S. PATENT DOCUMENTS

| | | | |
|---|---|---|---|
| 3,054,746 | 9/1962 | Gaden | 134/3 |
| 3,275,404 | 9/1966 | Firsching | 556/148 |
| 3,393,233 | 7/1968 | Richter | 556/148 |
| 3,451,807 | 6/1969 | Scribner et al. | 556/148 |
| 3,615,817 | 10/1971 | Jordan et al. | 210/698 |
| 3,669,631 | 6/1972 | Dietrick et al. | 423/20 |
| 3,694,369 | 9/1972 | Orlandini | 210/682 |
| 3,791,981 | 2/1974 | Calmon | 252/626 |
| 4,157,336 | 6/1979 | Jordan | 260/429 R |
| 4,226,640 | 10/1980 | Bertholdt | 134/3 |
| 4,243,638 | 1/1981 | Jackovitz et al. | 423/17 |
| 4,636,336 | 1/1987 | Gay et al. | 252/632 |
| 4,681,705 | 7/1987 | Roertson | 252/631 |
| 4,704,235 | 11/1987 | Arvesen | 252/626 |
| 4,705,573 | 11/1987 | Wood et al. | 134/3 |

OTHER PUBLICATIONS

R. Hay, K. Nolan; "Reactions of Co-ordinated Liganos, Hydrolysis of Tetramethyl Ethylene-diaminetetra--acetate and its Cooper (II) complexes" Chem. Soc., Dalton Trans., 1975 (13) pp. 1348-1351.

*Primary Examiner*—Brooks H. Hunt
*Assistant Examiner*—Ngoclan Mai
*Attorney, Agent, or Firm*—Allegretti & Witcoff, Ltd.

[57] ABSTRACT

A process for removing metal salts from an $H_4EDTA$ precipitate by esterification with an esterification reagent to produce an esterification mixture comprising a solid metal salt an EDTA ester and thereafter separating the solid metal salt from the esterification mixture.

19 Claims, No Drawings

PROCESS FOR CLEANING TRACE METALS FROM EDTA

BACKGROUND OF THE INVENTION

EDTA (ethylene diamine tetraacetic acid) is used as a chelating agent for cleaning scale from steam generators used for pressurized water reactors. These steam generators accumulate great quantities of precipitated iron oxides that reduce the heat transfer coefficient and the efficiency of the steam generator. Periodically, it is necessary to clean the precipitated material from these steam generators.

A 10–15% ammonium EDTA salt solution is typically injected into the steam generator. Since EDTA is a powerful chelating agent, it coordinates the iron and solubilizes it. In nuclear power plants, the shell side or secondary side of these steam generators is supposed to be the "clean" side. However, minor leaks in the tubes may occur allowing material from the primary side to leak low levels of radioactivity to the "clean" side, primarily in the form of radioisotopes of cesium cobalt and other metals.

Acidifying the metal salt containing EDTA chelating solution produces a metal salt contaminated $H_4EDTA$. The cost of stabilization, transportation and disposal of these wastes are high, making volume reduction of the metal salt containing $H_4EDTA$ precipitate a cost-effective alternative.

INFORMATION DISCLOSURE STATEMENT

The reduction of the volume of radioactive waste products resulting from steam generator cleaning has been the subject of various U.S. patents. However, none of the patents discloses or anticipates a process for eliminating radioactive salts from an EDTA acid precipitate.

U.S. Pat. No. 3,669,631 to Bellbrook, et al. discloses a process for removing radioactive materials from ion-exchange resins. The ion-exchange resins are used to remove radioactive metal isotopes from a cleaning solution. The radioactive isotopes are recovered by dissolving the ion-exchange resins in an acid/catalyst mixture and thereafter recovering the radioactive isotopes from the solution.

U.S. Pat. No. 3,791,981 to Calmon discloses a method for reducing the volume of radioactive contaminated ion-exchange resins prior to their disposal. The method consists of contacting the ion-exchange resins with an organic solvent to physically reduce the ion-exchange resin volume.

U.S. Pat. No. 4,704,235 to Arvesen discloses a steam generator descaling method that is accomplished in a single step in the absence of EDTA.

U.S. Pat. No. 4,705,573 to Wood et al. discloses a descaling process that does not use EDTA. The process comprises contacting a scale-containing surface with a specific reagent. No mention of subsequent reagent purification is made.

An article by Robert W. Hay et al. entitled *Reactions of Co-ordinated Ligands. Hydrolysis of Tetramethyl Ethylene-diaminetetra-acetate and its Copper* (II) *Complexes* discloses methods of producing $Me_4EDTA$ from $H_4EDTA$.

SUMMARY OF THE INVENTION

A principal object of this invention is to provide a process for removing metal contained in an $H_4EDTA$ complex. The process results in a significant reduction in the volume of the unwanted metal containing $H_4EDTA$ complex prior to disposal. Accordingly, in a broad embodiment the present invention is a process for removing metal contained in a metal contaminated $H_4EDTA$. The metal containing $H_4EDTA$ complex undergoes esterification in the presence of an esterification reagent to produce an esterification mixture comprising a metal salt and a liquid EDTA ester. The metal salt is then separated from the esterification mixture.

In a preferred embodiment, the invention is a process for removing radioactive metal salts contained in an $H_4EDTA$ precipitate. The radioactive metal salt is removed by esterifying a radioactive metal salt containing $H_4EDTA$ with an esterification reagent, in the presence of an organic solvent, at esterification conditions including a temperature of from about 0° C. up to about the boiling point of the esterification reagent but no greater than 220° C. for a period of time ranging from 15 minutes to about 24 hours or more to provide an esterification mixture comprising a solid radioactive metal salt, excess organic solvent and a liquid esterified EDTA. The liquid esterified EDTA is then recovered from the mixture.

DETAILED DESCRIPTION OF THE PREFERRED EMBODIMENTS

The present invention is a process for removing residual metal salts trapped in an EthyleneDiamineTetraAcetic acid ($H_4EDTA$) precipitate. $H_4EDTA$ is a white crystalline solid that does not melt but decomposes at 220° Centigrade. In addition, $H_4EDTA$ is almost insoluble in water, acids or organic liquids. Metal containing $H_4EDTA$ precipitates are produced from EDTA salts used as chelating agents. EDTA salt solutions may be used as chelating agents to scavenge entrapped metals such as metals from ion-exchange resins or from scale built up in heat exchangers and similar equipment. EDTA chelating agents are primarily useful in the nuclear power industry for removing materials such as isotopes of plutonium, uranium, thorium, actinium, cesium, cobalt, or other heavy-element isotopes that are contained in scale built up on equipment or that have been entrapped by ion-exchange resins.

EDTA salt solutions, contaminated with metals such as radioactive metals are typically acidified to convert the contaminated EDTA into a contaminated $H_4EDTA$ precipitate and to convert the metal into a metal salt. The solid metal salts cannot be removed from the $H_4EDTA$ precipitate by applying physical processes such as extraction or fractional crystallization. Typically, the solid metal salt containing $H_4EDTA$ is disposed of in a landfill. However, it has now been discovered that the solid metal salt can be removed and recovered from the $H_4EDTA$ precipitate by subjecting the metal salt containing $H_4EDTA$ precipitate to the esterification process of this invention. The EDTA ester produced by the esterification step can thereafter be disposed of by incineration, landfill, or the EDTA ester can be hydrolyzed to return it once again into $H_4EDTA$ or into an EDTA salt.

The metal salts that are entrapped by the $H_4EDTA$ may be any metal salt. What is important is that the metal salt is insoluble in the esterification reaction solution such that it may be separated and recovered from said solution. The process of this invention is most useful for removing radioactive metal salts trapped in an $H_4EDTA$ precipitate. Such salts might, for example, contain isotopes of radioactive metals such as cobalt, cesium, cerium, plutonium, iridium or salts of any radioactive metal isotopes. It is most probable that the radioactive metal salt will be a salt of cesium or cobalt.

According to the process of this invention, the metal containing $H_4EDTA$ complex must undergo esterification in order to remove the metal salt therefrom. The purpose of the esterification reaction is to create an EDTA ester that is soluble in the organic solvent of the esterification mixture or soluble in the excess of the esterifying reagent, while the solid metal salts remain insoluble in the esterification mixture. After the $H_4EDTA$ precipitate containing metal salts has been eterified, the insoluble solid metal salt can then be recovered from the solution.

The solid metal salt containing $H_4EDTA$ precipitate is esterified in the presence of an esterification reagent. The esterification reagent may be any liquid reagent capable of converting the $H_4EDTA$ precipitate into an EDTA ester. Preferred esterification reagents are alcohols. It is further preferred that the alcohols are primary alcohols such as methanol, ethanol, propanol, butanol, and like primary alcohols. The esterification of $H_4EDTA$, an organic acid, with an alcohol such as methanol produces an EDTA ester following the formula below:

$$[-CH_2-N(CH_2COOH)_2]_2+4\,ROH \rightarrow [-CH_2-N(CH_2COOR)_2]_2+4H_2O$$

where R is an aromatic or aliphatic radical.

From the formula above, it can be seen that the esterification reaction between an organic acid and a primary alcohol produces water. The esterification reaction is typically promoted by removing the water from the reaction mixture by any method available that does not interfere with the esterification reaction. Such methods might include distillation where the esterification reagent has a higher boiling point than the water, chemical means such as a solid desiccant added to the esterification mixture, or other means such as the addition of liquids that complex with the water or by performing the reaction in the presence of a catalyst.

When butanol is used as the esterification reagent, the esterification reaction product is tetra butyl EthyleneDiamineTetraAcetate or tetra butyl EDTA. Tetra Butyl EDTA is believed to be a heretofore unknown composition of matter having the chemical formula:

$$[-CH_2-N(CH_2COOCH_2CH_2CH_2CH_3)_2]_2$$

Tetra butyl EDTA is produced by combining a butyl alcohol such as n-butanol with an acidic solution containing $H_4EDTA$. The n-butanol combined with the $H_4EDTA$ to produce tetra butyl EDTA.

The esterification reaction may occur in the presence of an organic solvent. The organic solvent may be the same as the esterification reagent. The purpose of the organic solvent is to stabilize the esterification reaction conditions such as temperature and to promote the contact of the esterification reagent with the metal salt containing $H_4EDTA$ precipitate. Additionally, the solvent may dilute the effect of water on the esterification reaction rate. The organic solvent may be polar or nonpolar. It is also preferred that the organic solvent be non-protic. By non-protic, it is meant that the organic solvent has no protons to donate to a chemical reaction. It is preferred that the organic solvent is methanol.

The conditions at which the esterification reaction can occur will depend somewhat upon the choice of esterification reagent and the optional organic solvent. Temperature typically promotes the esterification reaction. Therefore, the higher the temperature at which the esterification occurs, the speedier the reaction rate. However, there are some inherent limitations to the esterification of $H_4EDTA$. As mentioned above, $H_4EDTA$ begins to decompose at 220° C. at atmospheric pressure. Therefore, 220° C. is anticipated to be the maximum temperature at which this esterification reaction can occur. Furthermore, it is likely that the chosen esterification reagent or the organic solvent will boil at a temperature below 220° C. Therefore, the esterification reaction may occur at a temperature up to about 220° C. but at or below the boiling point of the organic solvent and/or the esterification reagent chosen. The pressure of the system can be adjusted to increase the temperature at which the esterification reagent or the organic solvent will boil, thus allowing an esterification reaction to occur at a higher temperature than would be allowed if the reaction were occurring at atmospheric pressure.

Using the preferred organic solvent methanol and the preferred esterification reagent methanol, the esterification reaction can occur at a temperature from about 0° C. up to the temperature of the boiling point of methanol. The pressure at which the esterification reaction occurs may be modified from about atmospheric pressure up to any pressure necessary to raise the reaction temperature to about 220° C., at which point the $H_4EDTA$ precipitate begins to decompose. The reaction will typically take from about 15 minutes or longer to be complete. It is preferred that the reaction occurs from about 15 minutes to about 24 hours.

The esterification reaction may occur in the presence of an esterification catalyst. Compounds that catalyze the esterification reaction include strong acids, tin salts, organotitanates, silica gel, and cation-exchange resins. It is preferred that the esterification catalyst is a strong acid such as sulfuric acid.

As previously mentioned, the solid metal salt containing $H_4EDTA$ precipitate is preferably esterified in the presence of methanol used as both the esterification reagent and as the esterification solvent. The esterification reaction occurs at a pressure ranging from atmospheric pressure up to a pressure at which the boiling point of methanol is about 220° C. The temperature at which the esterification reaction takes place can be any temperature that does not exceed the boiling point of methanol. A preferred temperature range is from about 0° C. up to about the boiling point temperature of methanol at the particular pressure chosen.

An esterification reaction mixture is produced by the esterification reaction. The esterification reaction mixture typically comprises metal salts that are insoluble in the esterification mixture, organic solvent, and an EDTA ester. The esterification reaction mixture may also contain unreacted esterification reagent and unreacted $H_4EDTA$ precipitate. While it is preferred that insoluble metal salts are the only solid materials remaining in the esterification mixture, it is possible that some of the $H_4EDTA$ precipitate material will not become esterified. Even in this situation, the volume of $H_4EDTA$ precipitate containing metal salts will have been reduced by the esterification process. The disposal of the solid material will still be less problematic due to the reduction in volume of the material.

The esterification reaction mixture now undergoes a solid-liquid separation step. The purpose of the solid-liquid separation step is to remove the remaining metal salt containing material in the esterification reaction mixture from the esterification reaction mixture liquids. The solid-liquid separation may be accomplished by any means known in the art for separating a solid material from a liquid material such as, for example, mechanical separation means or distillation. It is preferred that a mechanical separation means be employed to effect the separation of the solids in the esterification reaction mixture from the esterification reaction mixture liquids. Such a mechanical separation means might be for example filtration, settling followed by decantation of the clarified liquid, or centrifugation. The act of separating the solids, including the solid metal salt, from the esterification reaction mixture produces a separated solid material containing solid metal salts and a clarified esterification mixture. At this point, the recovered solids, including solid metal salts, can be disposed of by landfill methods or other means. The clarified esterification mixture may then be subjected to a number of further processing steps or, alternatively, the clarified esterification solution may be disposed of by incineration or other means.

One processing option is to hydrolyze the clarified esterification mixture. Hydrolysis of the clarified esterification mixture essentially reverses the esterification reaction and converts the EDTA ester into $H_4EDTA$ or into EDTA salt. The hydrolysis will occur at hydrolysis conditions in the presence of an acidic or basic aqueous solution. As a result of the reaction of the clarified esterification mixture with water, a crude $H_4EDTA$ precipitate and a hydrolysis solution comprising organic solvent and water is produced. When an acidic hydrolysis solution is used, then the EDTA ester is hydrolyzed to $H_4EDTA$ precipitate. When a basic solution is used to hydrolyze the EDTA ester, then an EDTA aqueous salt is produced. When an $H_4EDTA$ precipitate is produced, it can be separated from the liquid by filtration, after which remaining solvent can be separated from the water by distillation and recovered. The filtered $H_4EDTA$ precipitate can then either be incinerated or recycled as a chelating agent for scale removal.

Optionally, the clarified esterification mixture comprising a reagent, a solvent, and EDTA ester may be subjected to liquid separation steps to recover essentially pure component streams of the clarified esterification solution. Such liquid separation steps might include, for example, distillation, adsorption or extraction. It is preferred that distillation be used to recover essentially pure fractions of the organic solvent, the esterification reagent and the EDTA ester.

The recovered organic solvent and esterification reagent can typically be recycled to the esterification step. The EDTA ester can be incinerated, or alternatively it can be subjected to hydrolysis conditions to produce a solid $H_4EDTA$ precipitate or an EDTA salt. The hydrolysis of the EDTA ester fraction also produces a small amount of reagent. The EDTA salt can be separated from the hydrolysis solution containing the esterification reagent and either recycled as a chelating agent or incinerated.

As mentioned above, the esterification reagent of this process is preferably methanol. Additionally, the organic solvent of this process is preferably methanol. In this case, the methanol that is not reacted with the $H_4EDTA$ precipitate would be separated from the EDTA ester by distillation and recycled back to the $H_4EDTA$ esterification step. The EDTA ester then undergoes incineration or hydrolysis, as discussed above.

Certain preferred examples of the invention will be discussed below. However, many other examples would also fall within the scope of the present invention.

EXAMPLES

EXAMPLE 1

In this example, $H_4EDTA$ contaminated with 170 ppm of nickel was subjected to trace metal cleaning. The nickel contaminated $H_4EDTA$ was combined with concentrated $H_2SO_4$ (1:10 molar ratio) and refluxed in an excess of n-butanol. Water, a reaction product, was removed from the reaction solution as an azeotrope with butanol. When the theoretical amount of water was collected, the hydrolysis was deemed complete and the reflux discontinued. A clear solution remained which was cooled to room temperature. The clear solution was washed with water and neutralized with a base followed by evaporation at room temperature. The clear liquid product was identified by $H^1$ and $C^{13}NMR^2$ as tetra butyl EthyleneDiamineTetraAcetate. The clear solution had a nickel concentration of only 8.36 ppm.

EXAMPLE 2

In this example, the tetra butyl EthyleneDiamineTetraAcetate of Example 1 was hydrolyzed and converted into $H_4EDTA$. The tetra butyl EthyleneDiamineTetraAcetate of Example 1 was combined with NaOH at a 1:10 molar ratio with an excess of water and refluxed gently while stirring for about fifteen hours. The pH of the solution was made acidic and the white solid $H_4EDTA$ produced by acidifying the solution was collected by filtration and dried in a vacuum of 70° C. to a constant weight. The nickel content of the solid $H_4EDTA$ was found to be 0.92 ppm.

EXAMPLE 3

A procedure essentially identical to that used to prepare the tetra butyl EthyleneDiamineTetraAcetate of Example 1 was used to prepare tetramethyl EthyleneDiamineTetraAcetate. In this example, $H_4EDTA$ contaminated with 170 ppm. of nickel and concentrated $H_2SO_4$ in a 1:10 molar ratio were refluxed in an excess of methanol to produce a tetramethyl EthyleneDiamineTetraAcetate. The tetramethyl EthyleneDiamineTetraAcetate was recovered from the solution. The nickel content of the ester was below 0.87 ppm.

EXAMPLE 4

The tetramethyl EthyleneDiamineTetraAcetate of Example 3 was hydrolyzed into $H_4EDTA$ in this example. The tetramethyl EthyleneDiamineTetraAcetate was mixed with NaOH in a 1:10 molar ratio with an excess of water and refluxed gently while stirring for about fifteen hours. The pH of the solution was made acidic and the solid $H_4EDTA$ was filtered from the acidified solution and dried in a vacuum oven at 70° C. to a constant weight. A nickel analysis of the recovered $H_4EDTA$ revealed a concentration below the detection level of 0.45 ppm.

What I claim is:

1. A process for reducing the metal salt concentration in metal salt contaminated $H_4EDTA$ comprising the following steps in combination:

(a) esterifying the metal salt contaminated $H_4EDTA$ in the presence of an esterification reagent to produce an esterification reaction mixture comprising a metal salt and a liquid EDTA ester, and (b) separating the metal salt from the esterification reaction mixture.

2. The process of claim 1 wherein esterifying the metal salt contaminated $H_4EDTA$ occurs in the presence of an organic solvent.

3. The process of claim 2 wherein the organic solvent is non-protic.

4. The process of claim 1 wherein the esterification reagent is an alcohol.

5. The process of claim 1 wherein the metal salt is a salt of a radioactive metal isotope.

6. A process for removing a radioactive metal salt contained in an $H_4EDTA$ precipitate comprising the following steps in combination:

(a) esterifying the $H_4EDTA$ precipitate containing radioactive metal salt in the presence of an esterification reagent and a non-protic organic solvent at a temperature of from about 0° C. to the lower boiling point temperature of either the non-protic organic solvent or the esterification reagent for a period of time ranging from 15 minutes to about 24 hours to produce an esterification reaction mixture comprising a solid radioactive metal salt, and an EDTA ester, and (b) separating the solid radioactive metal salt from the esterification reaction mixture to produce a separated solid including a solid radioactive metal salt, and a clarified esterification reaction mixture.

7. The process of claim 6 wherein the esterification reagent is a primary alcohol.

8. The process of claim 7 wherein the primary alcohol is methanol.

9. The process of claim 6 wherein the non-protic organic solvent is methanol.

10. The process of claim 6 wherein the solid radioactive metal salt is separated from the esterification mixture by filtration.

11. The process of claim 6 wherein the clarified esterification mixture is disposed of by incineration.

12. The process of claim 6 wherein the clarified esterification reaction mixture is hydrolyzed to produce a hydrolysis product including an $H_4EDTA$ precipitate essentially free of solid metal salts and an hydrolysis solution comprising non-protic organic solvent, water and alcohol.

13. The process of claim 12 wherein the essentially solid metal salt free $H_4EDTA$ precipitate is recovered from the hydrolysis solution, and the non-protic organic solvent and the alcohol are recovered from the hydrolysis solution and recycled to the esterification reaction.

14. The process of claim 6 wherein the clarified esterification mixture is distilled to produce essentially pure component streams of esterification reagent, organic solvent, excess alcohol and EDTA ester.

15. The process of claim 14 wherein the essentially pure streams of the esterification reagent, alcohol, and organic solvent are recycled for further use in the esterification reaction.

16. The process of claim 14 wherein the essentially pure EDTA ester stream is disposed of.

17. The process of claim 14 wherein the essentially pure EDTA ester stream is hydrolyzed under acidic conditions to produce an essentially solid metal salt free $H_4EDTA$ precipitate.

18. The process of claim 14 wherein the essentially pure EDTA ester stream is hydrolyzed at basic conditions to produce an essentially metal salt free EDTA salt solution.

19. A process for removing a solid radioactive metal salt contained in an $H_4EDTA$ precipitate comprising:

(a) esterifying the solid radioactive metal salt containing $H_4EDTA$ precipitate in the presence of methanol at a temperature of from about 0° C. to about the boiling point temperature of methanol but in any event no greater than about 220° C. for a period of time of from about 15 minutes to about 24 hours to produce an esterification reaction mixture comprising the solid radioactive metal salt, methanol, and EDTA ester, and (b) filtering the esterification reaction mixture to recover the solid radioactive metal salt and to define a clarified esterification reaction mixture.

* * * * *